US009850443B2

(12) United States Patent
Kitamura

(10) Patent No.: US 9,850,443 B2
(45) Date of Patent: Dec. 26, 2017

(54) AQUEOUS WORKING FLUID

(71) Applicant: IDEMITSU KOSAN CO., LTD., Chiyoda-ku (JP)

(72) Inventor: Tomohiko Kitamura, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/768,363

(22) PCT Filed: Mar. 5, 2014

(86) PCT No.: PCT/JP2014/055602
§ 371 (c)(1),
(2) Date: Aug. 17, 2015

(87) PCT Pub. No.: WO2014/136830
PCT Pub. Date: Sep. 12, 2014

(65) Prior Publication Data

US 2015/0376533 A1 Dec. 31, 2015

(30) Foreign Application Priority Data

Mar. 6, 2013 (JP) ..... 2013-044776

(51) Int. Cl.

| | |
|---|---|
| ***C10M 105/18*** | (2006.01) |
| ***C10M 145/26*** | (2006.01) |
| ***C10M 173/02*** | (2006.01) |
| ***C10M 105/14*** | (2006.01) |
| ***C10M 107/34*** | (2006.01) |
| ***C10M 105/08*** | (2006.01) |

(52) U.S. Cl.
CPC ..... *C10M 105/18* (2013.01); *C10M 105/08* (2013.01); *C10M 105/14* (2013.01); *C10M 107/34* (2013.01); *C10M 145/26* (2013.01); *C10M 173/02* (2013.01); *C10M 2207/022* (2013.01); *C10M 2209/104* (2013.01); *C10N 2220/021* (2013.01); *C10N 2230/12* (2013.01); *C10N 2240/401* (2013.01)

(58) Field of Classification Search
CPC C10M 105/18; C10M 145/26; C10M 173/02; C10M 105/14; C10M 107/34; C10M 2207/022; C10M 2209/104; C10M 105/08; C10N 2220/021; C10N 2230/12; C10N 2240/401
See application file for complete search history.

(56) References Cited

U.S. PATENT DOCUMENTS

| | | | | |
|---|---|---|---|---|
| 5,947,102 | A * | 9/1999 | Knepprath | B28D 1/025 125/12 |
| 2003/0078307 | A1 | 4/2003 | Shinohara et al. | |
| 2010/0086692 | A1 | 4/2010 | Ohta | |
| 2011/0240002 | A1 | 10/2011 | Grumbine et al. | |
| 2015/0133354 | A1 | 5/2015 | Kitamura | |

FOREIGN PATENT DOCUMENTS

| | | | |
|---|---|---|---|
| CN | 101910353 | A | 12/2010 |
| CN | 102369268 | A | 3/2012 |
| CN | 103 421 593 | A | 12/2013 |
| EP | 2 679 661 | A1 | 1/2014 |
| JP | 56 98294 | | 8/1981 |
| JP | 8 57848 | | 3/1996 |
| JP | 2003 82334 | | 3/2003 |
| JP | 2003-253599 | A | 9/2003 |
| JP | 2011 12249 | | 1/2011 |
| JP | 2011012249 | * | 1/2011 |
| JP | 2011 21096 | | 2/2011 |
| JP | 2011021096 | * | 2/2011 |
| JP | 2012 12504 | | 1/2012 |
| JP | 2012-87297 | A | 5/2012 |
| JP | 2012 512954 | | 6/2012 |
| JP | 2012-172117 | A | 9/2012 |
| JP | 2012-253105 | A | 12/2012 |
| TW | 201033343 | | 9/2010 |
| TW | 201111494 | | 4/2011 |
| WO | WO 2009/031515 | A1 | 3/2009 |

OTHER PUBLICATIONS

International Search Report issued Apr. 22, 2014 in PCT/JP2014/055602 filed Mar. 5, 2014.
Extended European Search Report issued on Oct. 14, 2016 in Patent Application No. 14760936.6.
Office Action issued on May 17, 2017, in the corresponding Taiwanese Patent Application No. 103107654, with English translation.
Combined Chinese Office Action and Search Report issued on Jan. 11, 2017, in Patent Application No. 201480009373.3 (with English translation).
Japanese Office Action issued on Sep. 16, 2016 in Patent Application No. 2013-044776.
Office Action issued Oct. 25, 2016 in Japanese Patent Application No. 2013-044776 (with English language translation).

* cited by examiner

*Primary Examiner* — Cephia D Toomer
(74) *Attorney, Agent, or Firm* — Oblon, McClelland, Maier & Neustadt, L.L.P.

(57) ABSTRACT

A water-soluble working fluid of the invention is used for cutting a brittle material using a wire saw. The water-soluble working fluid is provided by blending water, alkylene oxide adduct of acethylene glycol, and glycols. The water-soluble working fluid of the invention is capable of providing favorable cutting accuracy when the brittle material is cut using a wire, and thus is suitable for cutting out a large-diameter wafer. The water-soluble working fluid of the invention is especially suitably applicable to an abrasive-grain-fixed wire saw.

9 Claims, No Drawings

AQUEOUS WORKING FLUID

CROSS-REFERENCE TO RELATED APPLICATIONS

This application is the U.S. national-stage of PCT/JP2014/055602, filed Mar. 5, 2014, which claims the benefit of Japan 2013-044776, filed Mar. 6, 2013 both of which are incorporated by reference in their entireties.

TECHNICAL FIELD

The present invention relates to a water-soluble working fluid. Specifically, the present invention relates to a water-soluble working fluid used for cutting a brittle material using a wire saw.

BACKGROUND ART

In manufacturing semiconductor products, a silicon ingot (that is brittle in nature) needs to be cut. In such a case, a wire saw processing is generally employed in terms of cutting accuracy and productivity. Herein, a cutting method of the silicon ingot includes: a loose abrasive grain method of cutting the silicon ingot with a working fluid (machining fluid) in which grains are dispersed; and a fixed abrasive grain method of cutting the silicon ingot with a wire having grains fixed on its surface in advance.

The working fluid used for the loose grain method includes a water-soluble working fluid containing, for instance, a friction coefficient reducer, an auxiliary corrosion-resistance agent and the like. The friction-coefficient reducer contained in the working fluid is an unsaturated fatty acid. The auxiliary corrosion-resistance agent is benzotriazole (see Patent Literature 1). According to the loose grain method, a large margin is required when a thick wire is used, so that a large amount of cut particles are generated and the yield rate after cutting a silicon ingot is deteriorated. Further, since the wire is worn after being used, there naturally is a limit for reducing a diameter of the wire. Accordingly, the productivity of the loose grain method is not so good for use in manufacturing silicon wafers for solar cells and the like, of which production is expected to greatly increase in the future.

On the other hand, the working fluid used for the fixed grain method includes a water-soluble working fluid containing, for instance, glycols (see Patent Literatures 2 and 3). According to the fixed grain method, since abrasive grains are rigidly attached to a wire in advance, the diameter of the wire can be reduced and less amount of cut particles are produced, so that productivity can be enhanced.

CITATION LIST

Patent Literatures

Patent Literature 1 JP-A-8-57848
Patent Literature 2 JP-A-2003-82334
Patent Literature 3 JP-A-2011-21096

SUMMARY OF THE INVENTION

Problems to be Solved by the Invention

In recent years, the diameter of wafers (Si or SiC) is increasing. However, even when a silicon ingot is cut with a wire saw using the above-described working fluid to obtain a large-diameter wafer, sufficient cutting accuracy could not be necessarily obtained. Specifically, flatness of the obtained wafer is reduced or the obtained wafer is greatly warped.

An object of the invention is to provide a water-soluble working fluid capable of providing an excellent cutting accuracy in cutting a brittle material using a wire saw.

Means for Solving the Problems

The inventor of the invention has found that, in cutting a brittle material using a wire saw, the cutting accuracy is deteriorated when the permeability of the working fluid into a work gap between the wire saw and the material is low. Further, it has also come to be known that, by simply raising the permeability of the working fluid, the fluid is greatly foamed to impair the cutting process (e.g. spill-over from a tank, difficulty in controlling a flow rate of the device). The inventor has found that, with a use of a specific additive, sufficient permeability into a work gap can be ensured while restraining bubbling of the fluid, thereby reaching the invention.

Specifically, the invention provides the following water-soluble working fluid.

(1) A water-soluble working fluid adapted to be used for cutting a brittle material using a wire saw, the working fluid including: water; an alkylene oxide adduct of acetylene glycol; and glycols.

(2) The water-soluble working fluid according to the above aspect of the invention, in which HLB of the alkylene oxide adduct of acetylene glycol is in a range from 2 to 18.

(3) The water-soluble working fluid according to the above aspect of the invention, in which the alkylene oxide adduct of acetylene glycol comprises two alkylene oxide adducts of acetylene glycol of which difference in HLB is 1 or more.

(4) The water-soluble working fluid according to the above aspect of the invention, in which a number average molecular weight of the glycols is in a range from 60 to 100,000.

(5) The water-soluble working fluid according to the above aspect of the invention, in which a content of the alkylene oxide adduct of acetylene glycol is in a range from 0.005 to 10 mass % based on a total amount of the working fluid.

(6) The water-soluble working fluid according to the above aspect of the invention, in which a content of the glycols is in a range from 0.5 to 30 mass % based on the total amount of the working fluid.

(7) The water-soluble working fluid according to the above aspect of the invention, in which a pH of the working fluid is in a range from 4 to 8.

(8) The water-soluble working fluid according to the above aspect of the invention, in which a viscosity of the working fluid is in a range from 0.8 mPa·s to 15 mPa·s.

(9) The water-soluble working fluid according to the above aspect of the invention, in which the wire saw is an abrasive-grain-fixed wire saw.

(10) The water-soluble working fluid according to the above aspect of the invention, in which the brittle material is an ingot of silicon, silicon carbide, gallium nitride or sapphire.

The water-soluble working fluid of the invention is capable of obtaining favorable cutting accuracy with less foam when the brittle material is cut using a wire, and thus is suitable for cutting out a large-diameter wafer. The water-soluble working fluid of the invention is especially suitably applicable to an abrasive-grain-fixed wire saw.

DESCRIPTION OF EMBODIMENT(S)

A water-soluble working fluid of the exemplary embodiment (sometimes simply referred to as "the present working fluid" hereinafter) is used for cutting a brittle material using a wire saw. The water-soluble working fluid is provided by blending alkylene oxide adduct of acetylene glycol and glycols into water.

Accordingly, a main component of the present working fluid is water. Any water can be used without specific limitation. However, the water is preferably purified water, especially preferably deionized water. The content of water is preferably in a range from 50 to 99 mass %, more preferably in a range from 60 to 95 mass % based on the total amount of the working fluid. The 50 mass % or more content of water lowers inflammability to improve safety, which is also favorable in terms of resource saving and environmental consciousness. The upper limit of water is preferably 99 mass % in view of the content of the other component(s).

It should be noted that, though the present working fluid may be prepared by blending additional components at a required concentration, condensed fluid (stock solution) of the present working fluid may be prepared in advance and diluted in use. The concentration of the condensed fluid is preferably adjusted so that the condensed fluid is diluted to about 2 to 160 times (volume magnification) in use in view of handling ability.

The alkylene oxide adduct of acetylene glycol blended in the present working fluid serves as a so-called nonionic surfactant. The addition of such a specific surfactant improves wettability of the present working fluid, so that the present working fluid can easily permeate into the gap between a wire and an object to be processed (brittle material).

The alkylene oxide adduct of acetylene glycol disclosed in, for instance, JP-A-2011-12249 and JP-A-2012-12504 is suitably usable as the alkylene oxide adduct of acetylene glycol of the present working fluid.

Specific examples of the alkylene oxide adduct of acetylene glycol are: 2,5,8,11-tetramethyl-6-dodecyne-5,8-diol, 5,8-dimethyl-6-dodecyne-5,8-diol, 2,4,7,9-tetramethyl-5-dodecyne-4,7-diol, 8-hexadecyne-7, 10-diol, 7-tetradecyne-6,9-diol 2,3,6,7-tetramethyl-4-octyne-3,6-diol, 3,6-diethyl-4-octyne-3,6-diol, 2,5-dimethyl-3-hexyne-2,5-diol, 2,4,7,9-tetramethyl-5-decyne-4,7-diol, and 3,6-dimethyl-4-octyne-3,6-diol. Examples of the alkylene oxide include ethylene oxide (EO) and propylene oxide (PO).

The above-described alkylene oxide adduct of acetylene glycol preferably has an HLB (Hydrophile-Lipophile Balance) in a range from 2 to 18 in terms of improvement in wettability, more preferably in a range from 3 to 16. When the HLB is 2 or more, the solubility in the present working fluid is further enhanced. When the HLB is 18 or less, the wettability to the wire can be further enhanced and the working fluid is less likely to be foamed.

Further, the alkylene oxide adduct of acetylene glycol preferably includes two types of the adducts of which difference in HLB is 1 or more. When the above adducts with HLB difference of 1 or more are contained in the present working fluid, since the affinity to both of water and wire is enhanced, the wettablity to the wire can be further enhanced. Accordingly, the difference in HLB is preferably 2 or more, further preferably 3 or more.

It is preferable that the content of the alkylene oxide adduct of acetylene glycol is in a range from 0.005 to 10 mass % based on a total amount of the working fluid, more preferably in a range from 0.01 to 5 mass %, further preferably in a range from 0.03 to 3 mass %.

When the content is 0.005 mass % or more, sufficient wettablity enhancement effect can be expected. When the content is 10 mass % or less, undissolved residue is unlikely to be generated and antifoamability is improved.

The present working fluid further contains glycols. The addition of glycols improves solubility of the above-described alkylene oxide adduct of acetylene glycol.

The number average molecular weight of the glycols is preferably in a range from 60 to 100,000, more preferably 70 to 80,000, further preferably 80 to 50,000. When the number average molecular weight is 60 or more, the working fluid is not easily volatilized and sufficient processing performance can be ensured. On the other hand, when the number average molecular weight is 100,000 or less, excellent shear stability can be obtained and properties of the present working fluid is unlikely to be altered.

Examples of the glycols include aqueous glycols such as: ethylene glycol, propylene glycol, 1,4-butanediol, hexamethylene glycol, neopenthyl glycol, diethylene glycol, triethylene glycol, dipropylene glycol, tripropylene glycol, polyethylene glycol, polypropylene glycol, a copolymer of polyethylene glycol and polypropylene glycol, and a copolymer of polyoxyethylene and polyoxypropylene; glycolmonoalkylether such as triethylene glycolmonobutylether, triethylene glycolmonomethylether, diethylene glycolmonobutylether and tripropylene glycolmonomethylether; and a monoalkylether of a copolymer of polyoxyethylene and polyoxypropylene.

A single one of the above glycols may be used alone, or two or more of the above glycols may be used in combination. Among the above exemplary glycols, propylene glycol, dipropylene glycol, diethylene glycol, triethylene glycol, polyethylene glycol, polypropylene glycol, or a copolymer of polyethylene glycol and polypropylene glycol is preferable.

It is preferable that the content of the above glycols is in a range from 0.5 to 30 mass % based on the total amount of the working fluid, more preferably in a range from 1 to 20 mass %.

When the content is 0.5 mass % or more, the solubility of the alkylene oxide adduct of acetylene glycol is improved, thereby being less likely to generate undissolved residue to improve the performance of the present working fluid. Further, even when the content is 30 mass % or less, the advantages of the working fluid can be sufficiently exhibited, which is favorable in terms of resource-saving.

The pH of the present working fluid is preferably in a range from 4 to 8. When the pH of the present working fluid is within the above range, the foamability of the present working fluid is further restrained. Further, with the pH of the present working fluid in the above range, hydrogen is less likely to be generated, thereby providing extremely favorable performance in terms of safety and foamability.

The viscosity of the present working fluid at 25 degrees C. is preferably in a range from 0.8 mPa·s to 15 mPa·s, more preferably in a range from 2 mPa·s to 10 mPa·s, further preferably in a range from 3 mPa·s to 8 mPa·s.

When the viscosity of the present working fluid is 0.8 mPa·s or more, adhesion property to the wire is improved, thereby enhancing lubricity and cutting accuracy. When the viscosity is 15 mPa·s or less, permeability into the work gap can be sufficiently exhibited, so that wire flexure can be reduced and cutting accuracy can be further improved.

When the present working fluid is used as a cutting fluid, an ingot of a hard brittle material (e.g. Si, SiC, GaN and sapphire) can be cut at a high speed with a multi-wire saw, so that wafers with a high accuracy can be obtained. Examples of the other brittle materials include quartz, neodymium magnet, alumina, zirconia, silicon nitride, niobate and tantalite. The present working fluid is especially suitable for an abrasive-grain-fixed wire.

The diameter of the abrasive-grain-fixed wire is preferably 0.2 mm or less, more preferably 0.12 mm or less, further preferably 0.1 mm or less and especially preferably 0.08 mm or less. When the diameter of the wire saw is reduced, a yield rate of the products from the brittle material to be processed can be increased. With the use of the present working fluid, the abrasive grains more efficiently bites into the object to be cut, so that cutting efficiency can be improved. Accordingly, flexure of a wire saw can be restrained even when a wire saw with a small diameter is used. However, in terms of strength of the wire saw, the diameter of the wire saw is preferably 0.06 mm or more.

It should be noted that the working fluid of the invention may be added with known additive(s) including rust inhibitor, friction modifier, antifoaming agent, metal deactivator, bactericide (preservative), pH modifier and the like, as long as the addition of the additive(s) does not impair the advantage(s) of the invention.

Examples of the rust inhibitor include alkylbenzenesulfonate, dinonylnaphthalenesulfonate, alkenyl succinate and polyhydric alcohol ester. A content of the rust inhibitor is preferably in a range approximately from 0.01 mass % to 5 mass % of the total amount of the working fluid.

The friction modifier is used for restraining the abrasion of the abrasive grains. Various surfactants are usable as the friction modifier. Examples of the surfactant include nonionic surfactant such as glycols. A content of the friction modifier is preferably in a range of approximately 0.01 mass % to 5 mass % of a total amount of the working fluid.

The antifoaming agent is used for keeping the working fluid from spilling out of the working fluid tank provided inside the processing chamber. Examples of the antifoaming agent include silicone oil, fluorosilicone oil and fluoroalkylether. A content of the rust antifoaming agent is preferably in a range of approximately 0.001 mass % to 1 mass % of a total amount of the working fluid.

Examples of the metal deactivator include imidazoline, pyrimidine derivative, thiadiazole and benzotriazole. A content of the metal deactivator is preferably in a range of approximately 0.01 mass % to 5 mass % of a total amount of the working fluid.

The bactericide (preservative) is used for preventing corrosion of the working fluid. Examples of the bactericide (preservative) include paraoxy benzoic acid esters (parabens), benzoic acid, salicylic acid, sorbic acid, dehydroacetic acid, p-toluenesulfonic acids and salts thereof, and phenoxyethanol. A content of the bactericide is preferably in a range of approximately 0.01 mass % to 1 mass % of a total amount of the working fluid.

The pH modifier is used for appropriately adjusting the pH of the working fluid in a range from 4 to 8. With the pH in the above range, the following advantages can be provided in addition to the above-described advantages. Specifically, when the pH is 4 or more, rust inhibition property is improved. When the pH is 8 or less, the corrosion of silicon can be further effectively restrained.

Examples of the pH modifier include an organic acid such as acetic acid, malic acid and citric acid, a salt thereof, a phosphate and a salt thereof.

EXAMPLES

Next, the invention will be described below in detail with reference to Examples. It should be noted, however, that the scope of the invention is by no means limited by the Examples.

Examples 1 to 6 and Comparatives 1 to 6

Water-soluble working fluids (sample fluid) with the blend composition shown in Tables 1 and 2 were prepared and were subjected to a cutting process and evaluation as described below. Tables 1 and 2 also show the results of the evaluation.

TABLE 1

| | | Ex. 1 | Ex. 2 | Ex. 3 | Ex. 4 | Ex. 5 | Ex. 6 |
|---|---|---|---|---|---|---|---|
| Composition of Sample Fluid (mass %) | Acetylene Glycol EO Adduct (HLB 4)[1)] | — | 0.03 | — | 0.01 | 0.01 | 0.01 |
| | Acetylene Glycol EO Adduct α (HLB 8)[2)] | 0.15 | 0.10 | 0.15 | 0.08 | 0.08 | — |
| | Acetylene Glycol EO Adduct β (HLB 8)[3)] | — | — | — | — | — | 0.05 |
| | Acetylene Glycol EO Adduct (HLB 13)[4)] | — | — | 0.10 | 0.10 | 0.10 | 0.05 |
| | Block Copolymer of EO and PO[5)] | — | — | — | — | — | — |
| | Polyoxyalkylene alkylether (HLB 14)[6)] | — | — | — | — | — | — |
| | Diethylene glycol | 5.00 | 5.00 | 5.00 | 5.00 | — | 5.00 |
| | Propylene glycol | — | — | — | — | 5.00 | — |
| | Ion-exchanged water | 94.85 | 94.87 | 94.75 | 94.81 | 94.81 | 94.89 |
| Evaluation Results | Contact Angle on Nickel Plate (°) | 23 | 14 | 4 | 7 | 7 | 7 |
| | Antifoaming Property (Dissipation time of surface bubbles [sec.].) | 3 | 2 | 3 | 3 | 3 | 2 |
| | Accuracy of Cut Silicon Wafer (SORI) | A | A | A | A | A | A |

TABLE 2

| | | Comp. 1 | Comp. 2 | Comp. 3 | Comp. 4 | Comp. 5 | Comp. 6 |
|---|---|---|---|---|---|---|---|
| Composition of Sample Fluid (mass %) | Acetylene Glycol EO Adduct (HLB 4)[1)] | — | 0.01 | — | — | — | — |
| | Acetylene Glycol EO Adduct α (HLB 8)[2)] | — | — | — | — | — | — |
| | Acetylene Glycol EO Adduct β (HLB 8)[3)] | — | — | — | — | — | — |
| | Acetylene Glycol EO Adduct (HLB 13)[4)] | — | — | 0.10 | — | — | 0.10 |
| | Block Copolymer of EO and PO[5)] | — | — | — | 0.20 | — | — |
| | Polyoxyalkylene alkylether (HLB 14)[6)] | — | — | — | — | 0.20 | — |
| | Diethylene glycol | — | — | — | — | — | 86.90 |
| | Propylene glycol | — | — | — | — | — | — |
| | Ion-exchanged water | 100.00 | 99.99 | 99.90 | 99.80 | 99.80 | 13.00 |

TABLE 2-continued

| | | Comp. 1 | Comp. 2 | Comp. 3 | Comp. 4 | Comp. 5 | Comp. 6 |
|---|---|---|---|---|---|---|---|
| Evaluation Results | Contact Angle on Nickel Plate (°) | 74 | N/A | 31 | 33 | 22 | 33 |
| | Antifoaming Property (Dissipation time of surface bubbles [sec.].) | 1 | N/A | 60< | 60< | 60< | 60< |
| | Accuracy of Cut Silicon Wafer (SORI) | B | B | B | B | B | B |

[1)]EO adduct of 2,4,7,9-tetramethyl-5-decyne-4,7-diol
[2)]EO adduct of 2,4,7,9-tetramethyl-5-decyne-4,7-diol
[3)]EO adduct of 2,5,8,11-tetramethyl-6-dodecyne-5,8-diol
[4)]EO adduct of 2,4,7,9-tetramethyl-5-decyne-4,7-diol
[5)]NEWPOL PE64 manufactured by Sanyo Chemical Industries, Ltd.
[6)]NAROACTY CL-20 manufactured by Sanyo Chemical Industries, Ltd.

Processing Method

A silicon wafer was obtained by cutting a silicon ingot while supplying sample fluid to an abrasive-grain-fixed wire saw. Specific conditions were as follows.

Cutter: WSD-K2 (manufactured by Takatori Corporation)

Wire: electrodeposited diamond wire (diameter 0.10 mm, grain size 8 to 16 micrometers)

Workpiece (ingot): polycrystalline silicon (125 mm square)

Tension: 18 N

Wire Running Speed: 700 m/min

Supply of New Wire: 0.2 m/min

Duration of Time at Constant Speed of Wire: 10 s

Duration of Time at Acceleration and Deceleration of Wire: 3 s

Evaluation Method (1) Contact Angle

Contact angle meter: DM500 manufactured by Kyowa Interface Science Co., Ltd

Plate: Pure Nickel

Drop amount of sample fluid: 1 μL

Measurement method: After the sample fluid was dropped on a surface of the plate, a contact angle after 14.6 seconds elapsed was measured.

(2) Antifoaming Property 100 mL of the sample fluid was put into a 100-mL-volume measuring cylinder and was vigorously shaken up and down for five seconds. Subsequently, the time (seconds) until the bubbles generated on the fluid surface disappeared was measured.

(3) Cutting Accuracy (SORI)

A warpage (SORI) of the wafer obtained by the above-described cutting was measured as a standard of cutting accuracy. The warpage (SORI) is a parameter measured by a method defined by the technical standard QIAJ-B-007 established in Feb. 10, 2000 by Quartz Crystal Industry Association of Japan and represents undulation of the wafer in an unclamped condition by a maximum value of deviation from a flat surface (reference flat surface) in contact with a rear surface of the wafer. In Examples, the warpage (SORI) was measured using Nanometro 44F manufactured by KURODA Precision Industries Ltd. and was evaluated according to the following standards.

A: less than 50 μm

B: 50 μM or more

Evaluation Results

All of the sample fluids of Examples 1 to 6 were excellent in terms of the accuracy (SORI) of the silicon wafer cut out from the silicon ingot. On the other hand, since all of the sample fluids of Comparatives 1 to 6 contained no two requisite components of the invention, the accuracy (SORI) of the silicon wafer was extremely low. It should be noted that the accuracy (SORI) could not be measured in Comparative 2 since the EO adduct was not dissolved.

The invention claimed is:

1. A water-soluble working fluid adapted to be used for cutting a brittle material using a wire saw, the working fluid comprising:

50 mass % or more of water relative to a total amount of the working fluid;

an alkylene oxide adduct of acetylene glycol; and at least one non-polymeric glycol.

2. The water-soluble working fluid according to claim 1, wherein a hydrophile-lipophile balance (HLB) of the alkylene oxide adduct of acetylene glycol ranges from 2 to 18.

3. The water-soluble working fluid according to claim 2, wherein the alkylene oxide adduct of acetylene glycol comprises two alkylene oxide adducts of acetylene glycol of which difference in HLB is 1 or more.

4. The water-soluble working fluid according to claim 1, wherein a content of the alkylene oxide adduct of acetylene glycol ranges from 0.005 to 10 mass % based on the total amount of the working fluid.

5. The water-soluble working fluid according to claim 1, wherein a content of the at least one glycol ranges from 0.5 to 30 mass % based on the total amount of the working fluid.

6. The water-soluble working fluid according to claim 1, wherein a pH of the working fluid ranges from 4 to 8.

7. The water-soluble working fluid according to claim 1, wherein a viscosity of the working fluid ranges from 0.8 mPa·s to 15 mPa·s.

8. A method, comprising cutting a brittle material with an abrasive-grain-fixed wire saw in contact with the water-soluble working fluid of claim 1.

9. A method, comprising cutting a brittle material with a wire saw in contact with the water-soluble working fluid of claim 1, wherein the brittle material is an ingot of silicon, silicon carbide, gallium nitride or sapphire.

* * * * *